United States Patent [19]

MacDonald et al.

[11] Patent Number: 5,020,324

[45] Date of Patent: Jun. 4, 1991

[54] CHARGE FLOW PRIORITY CIRCUIT

[75] Inventors: Donald J. MacDonald, Waterloo; James A. Miller, Cedar Falls; Derek M. Eagles, Hudson, all of Iowa

[73] Assignee: Deere & Company, Moline, Ill.

[21] Appl. No.: 492,198

[22] Filed: Mar. 13, 1990

[51] Int. Cl.[5] ..... F04B 41/06

[52] U.S. Cl. ..... 60/430; 60/454; 60/456; 60/486; 417/252

[58] Field of Search ..... 60/430, 453, 456, 486, 60/488, 454; 417/205, 206, 251, 252, 253, 62, 199.1, 199.2

[56] References Cited

U.S. PATENT DOCUMENTS

| | | | |
|---|---|---|---|
| 2,642,804 | 6/1953 | Bowers | 417/252 X |
| 3,131,540 | 5/1964 | Ritter | 60/456 |
| 3,266,424 | 8/1966 | Bunting | 417/253 X |
| 3,588,285 | 6/1971 | Moon | 417/206 X |
| 3,785,157 | 1/1974 | Kittle et al. | 60/456 X |
| 3,912,419 | 10/1975 | Lutz et al. | 417/252 |
| 3,952,511 | 4/1976 | Turner et al. | 60/486 X |
| 4,173,867 | 11/1979 | Schmidt et al. | 60/456 |

*Primary Examiner*—Edward K. Look
*Assistant Examiner*—George Kapsalas

[57] ABSTRACT

A charge flow distribution valve routes all charge pump flow into a main pump until the main pump has sufficient inlet pressure. The valve opens to a first stage which routes excess charge flow to lubrication circuits. At a slightly higher main pump inlet pressure, it also routes oil to an inlet of the charge pump.

8 Claims, 2 Drawing Sheets

CHARGE FLOW PRIORITY CIRCUIT

BACKGROUND OF THE INVENTION

The present invention relates to a hydraulic system with a charge pump and a main pump, and more particularly to a hydraulic system in which a fixed displacement charge pump supplies fluid to a variable displacement main pump.

When an engine-driven fixed displacement charge pump is used to supply fluid to a variable displacement high pressure main pump, such as an axial piston pump, it is necessary to have the charge pump displacement large enough to satisfy the requirements of the main pump at low engine speeds. At high engine speeds, the output of the charge pump increases and provision must be made for excess flow not needed by the main pump. Typically, such excess flow is returned to sump via a relief valve. In applications where main pump flow is minimal much of the time, this technique circulates unneeded flow through the circuit and reservoir, contributing to aeration and power loss, or requires large line sizes to keep pressure drop low. It would be desirable to have such a system wherein a useful function is performed by the excess fluid flow and power loss is minimized.

SUMMARY OF THE INVENTION

An object of the present invention is to provide a system which includes a fixed displacement charge pump and a variable displacement main pump with a hydraulic circuit which routes excess fluid flow to useful hydraulic functions.

Another object of the present invention is to provide such a hydraulic circuit wherein excess charge flow is used for lubrication.

These and other objects are achieved by the present invention wherein a fixed displacement pump provides fluid flow via a filter/filter bypass circuit to a variable displacement main pump and to a priority/diverter valve. This priority/diverter valve is normally closed and gives first priority of flow to the main pump. In response to an increase in main pump inlet pressure, the valve routes excess charge flow to lubrication circuits. In response to a further increase in main pump inlet pressure, excess charge flow is routed to the lube circuits and to the charge pump inlet.

DETAILED DESCRIPTION OF THE PREFERRED EMBODIMENTS

Figure 1:
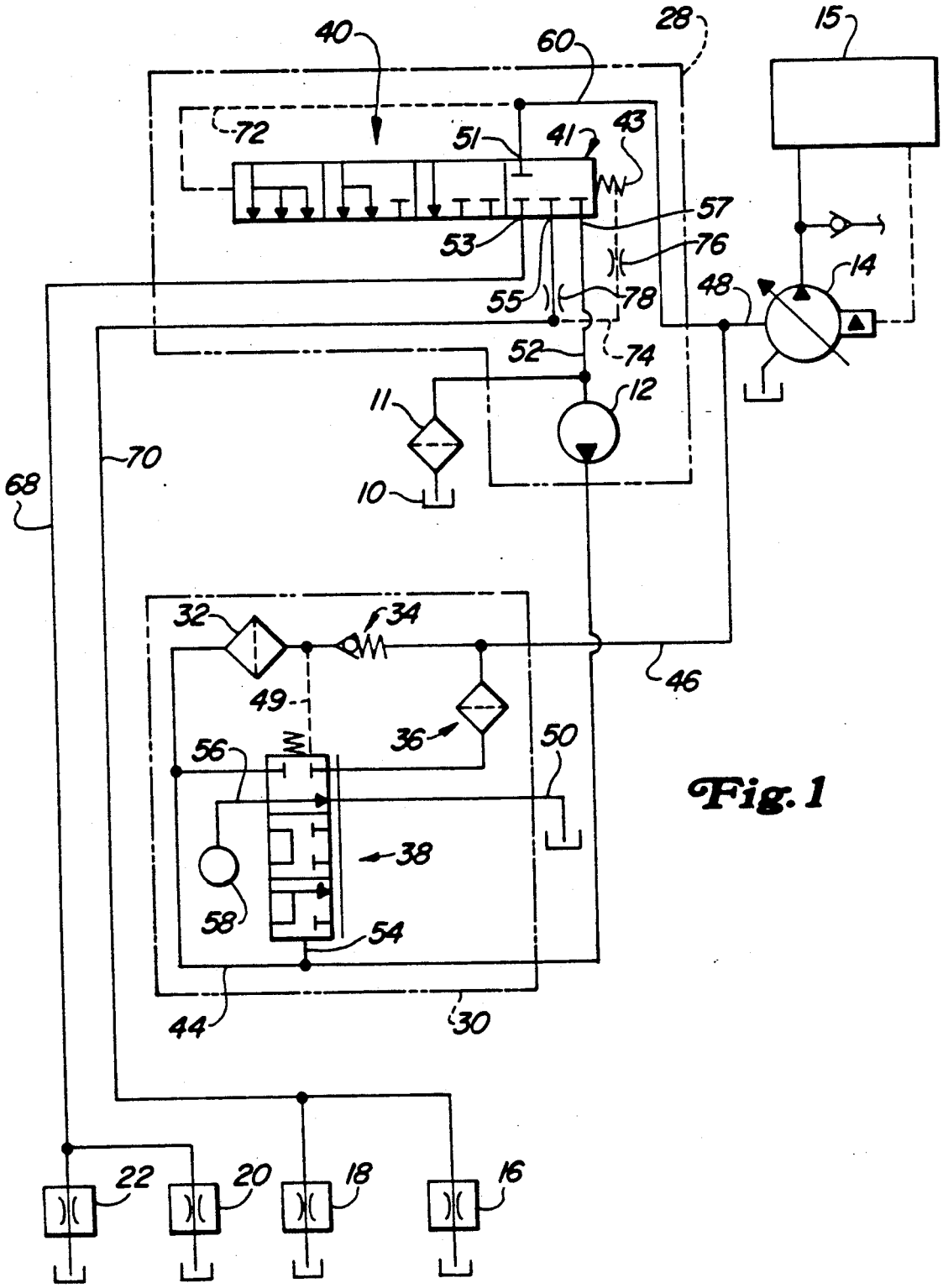
FIG. 1 is a simplified schematic diagram of a preferred embodiment of a charge pump/main pump hydraulic system including the hydraulic circuit of the present invention.

FIG. 1 shows a hydraulic system for a vehicle (not shown) which includes a sump !0, a coarse filter 11, an engine driven fixed displacement charge pump 12, an engine driven variable displacement main pump 14 (such as an axial piston pump or the equivalent) for supplying pressurized fluid to various hydraulic function 15 (such as steering, brakes and control valves), lube circuits, such as left and right final drive lube circuits 16, 18, a PTO clutch lube circuit 20 and a pump drive lube circuit 22.

A hydraulic control circuit 28 receives hydraulic fluid from the charge pump 12 via a filter/filter bypass circuit 30 and distributes fluid to the main pump 14 and to the lube circuits 16–22. The filter circuit 30 includes a filter 32, check valve 34, screen 36 (optional) and filter bypass valve 38. Line 44 routes fluid from charge pump 12 to the inlet of valve 38 and to the inlet side of filter 32. The outlet side of filter 32 is communicated to the inlet of main pump 14 via check valve 34 and lines 46 and 48, and to a spring cavity drain port of valve 38 via sense line 49. A first outlet of valve 38 is connected to line 46 via (optional) screen 36. A second outlet of valve 38 is connected to the sump 10 via line 50. Sense line 54 communicates line 44 with the pressure sensing port of valve 38. Line 56 connects a third outlet of valve 38 with a pressure-responsive switch 58 which is preferably connected to energize an indicator (such as a light bulb) on a vehicle dashboard when line 56 is pressurized.

Line 60 connects line 46 to inlet 51 of valve 40. A first outlet 53 of valve 40 is communicated with lube circuits 20 and 22 via line 68. A second outlet 55 is communicated with lube circuits 16 and 18 via line 70 through orifice 78. Passage 52 connects a third outlet 57 of valve 40 with the inlet of charge pump 12. Sense line 72 communicates main pump inlet pressure to one end of spool or valve member 41 of valve 40 while the other end of spool or valve member 41 is biased by spring 43 and is connected via orifice 76 and line 74 to line 70.

Initially, the oil is drawn through the coarse filter screen 11 into the charge pump 12. From there, it is pumped to the filter circuit 30. In the filter circuit 30, fluid is routed either through the oil filter 32 and the check valve 34 (check valve 34 prevents draining of line from charge pump 12 when the filter 32 is replaced), or through the filter bypass valve 38. The switch 58 gives an indication of near-bypass condition at 3.0 bar, but only allows oil to bypass at 5 bar differential across the filter. The bypass oil is routed through the 100 micron screen 36 and proceeds in the same path the oil would follow if filtered under normal conditions.

Next, the oil travels to a point where it can either flow to the inlet of the main pump 14, if needed, or if not needed, to the charge-pressure priority/diverter valve 40. No oil passes through the valve 40 unless a pressure above 0.5 bar is maintained at the inlet of the main pump 14. At 0.5 bar, valve 40 operates to route oil to the lube circuits 20 and 22. When these lube circuits reach a pressure of 1.0 bar, the valve 40 opens further and cooling oil flow is routed to lube circuits 16 and 18. When a pressure of 1.5 bar is reached at the priority valve 40, it diverts a portion of the incoming oil from the charge pump 12 and filter circuit to passage 52 which returns it to the inlet of the charge pump 12. To ensure minimum interaction between valve 40 and charge pump 12, the spring end of the spool 41 is connected through passage 74 and orifice 76 to line 70. To promote filter usage and cooling, a high proportion of charge oil should flow through the lube circuit at maximum engine speed.

Because the charge pump 12 is oversized, compared to the maximum needs of the main pump 14, some flow to the lube circuits will be available at all times. It is also anticipated that rarely will the main pump 14 operate at full displacement, and thus, the volume of oil available to the lube circuits should be more than sufficient for its needs. The bypass action of the priority/diverter valve 40 in directing excess charge oil to the charge pump inlet is intended to limit the flow of unfiltered oil through the oil filter 32. This is desired so that the system can operate with a charge pump capable of 2.3 l/s at high idle and yet filter only 1.0 l/s of unfiltered oil under most circumstances.

At the lowest anticipated engine speed of 600 rpm, flow from the charge pump 12 must be sufficient to operate the main pump 14 at full displacement.

Figure 2:
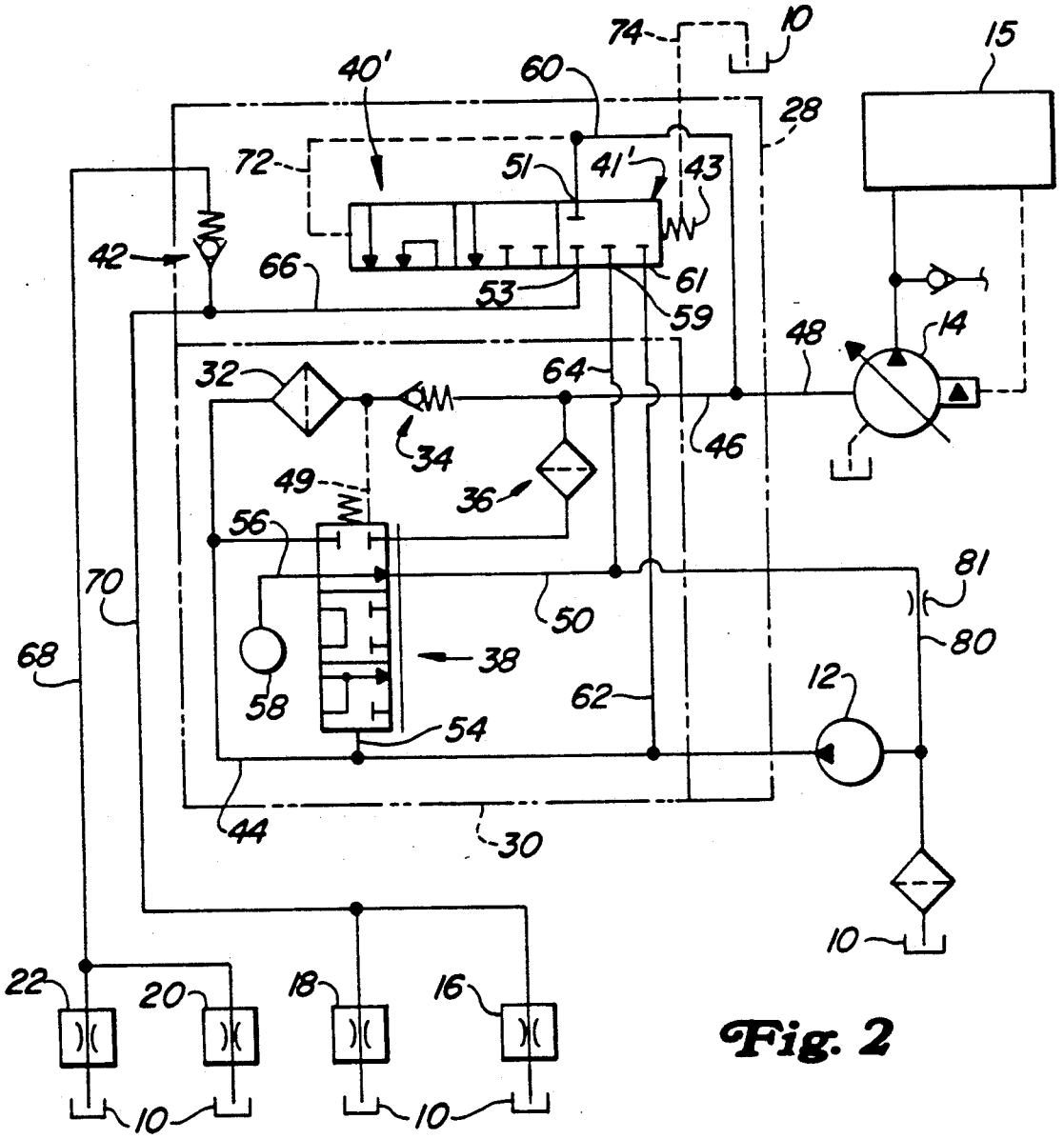
FIG. 2 is a simplified schematic diagram of an alternate embodiment of the present invention.

Referring now to FIG. 2, there is shown an alternate embodiment. However, in the FIG. 2. circuit line 64 connects outlet 59 to the inlet of charge pump 12 via line 80. Also, a line 62 connects a second inlet 61 of valve 40' to the outlet of charge pump 12. The valve 40' has a first position wherein all ports are blocked, a second position wherein inlet 51 is connected to outlet 53, and a third position wherein inlet 51 is connected to outlet 53 and inlet 61 is connected to outlet 59. Finally, in the FIG. 2 embodiment, outlet 53 is connected to lines 68 and 70 via a line 66 and a check valve 42 is placed in line 68 to permit one way fluid flow to functions 20 and 22 and also to give priority to flow to functions 16 and 18.

During cold weather operation, the charge pump 12 will supply oil to the main pump inlet, either through the filter 32, or, more likely, through the filter bypass valve 38. During this first operation, charge pressure will likely exceed the 1.5 bar required to bypass excess charge flow to the charge pump 12. Preferably, the circuit 28 is located approximately equidistant from the main pump inlet and charge pump inlet and the bypass line 80 includes a restriction 81 so that the priority of flow will still be given to the main pump 14. If no oil is required by the main pump 14, then charge flow will proceed to the charge pump 12 to aid in warming up the circuit, and also to lube circuits 16–20.

While the invention has been described in conjunction with specific embodiments, it is to be understood that many alternatives, modifications and variations will be apparent to those skilled in the art in light of the foregoing description. For example, the particular pressure levels and flow rates described herein are merely exemplary, and other pressure levels could be used depending on the application. Accordingly, this invention is intended to embrace all such alternatives, modifications and variations which fall within the spirit and scope of the appended claims.

We claim:

1. A hydraulic system comprising:

a sump;

a main pump for supplying pressurized fluid to a first hydraulic function;

a charge pump for transferring fluid from the sump to the main pump, the charge pump being capable of supplying fluid in excess of that which is required by the main pump;

a second hydraulic function; and a priority/diverter circuit connected to the charge pump, to the main pump and to the second hydraulic function for selectively distributing excess fluid from the charge pump to the second hydraulic function and to an inlet of the charge pump, the priority/diverter circuit comprising:

a feed line coupled between the outlet of the charge pump and the inlet of the main pump; and a pressure-responsive control valve having an inlet port communicated with the main pump inlet, a first outlet communicated with the second hydraulic function, a second outlet communicated with the inlet of the charge pump, and a valve member movable in response to fluid pressure at the main pump inlet from a first position wherein all ports are blocked to a second position wherein the inlet port in communicated with the first outlet, and to a third position wherein the inlet port is communicated to second outlet.

2. The hydraulic system of claim 1, wherein:

the pressure-responsive control valve further comprises a third outlet port communicated with a third hydraulic function; and the valve member is movable to a fourth position wherein the inlet port is communicated with the first, second and third outlets;

3. The hydraulic system of claim 1, wherein:

the second hydraulic function comprises first and second lube circuits;

the priority/diverter circuit comprises a first lube line communicating with the first lube circuit and a second lube line communicating with the second lube circuit; and a check valve in the second lube line prevents fluid flow through the second line unless fluid pressure in the first lube line exceeds a certain pressure.

4. The hydraulic system of claim 1, further comprising:

a filter; and a filter bypass valve to divert fluid around the filter to the main pump inlet when fluid pressure at an inlet of the filter exceeds a certain level.

5. The hydraulic system of claim 1, characterized by:

a feed line coupled between the charge pump outlet and the main pump inlet; and a control valve having an inlet communicated with an inlet of the main pump, an outlet communicated with the lubrication circuit, a first port communicated with an outlet of the charge pump, a second port communicated with an inlet of the charge pump, a valve member movable from a first position wherein the inlet and outlet ports are closed to a second position wherein the inlet is connected to the outlet and the first and second ports are blocked, resilient means biased to urge the valve member to its first position and pressure-responsive means for moving the valve member to the second position in response to fluid pressure at the inlet of the main pump.

6. The hydraulic system of claim 6, wherein the control valve is movable to a third position wherein the inlet is connected to the outlet and the first port is connected to the second port.

7. The hydraulic system of claim 5, further comprising:

a filter having one side communicated to the charge pump outlet and another side communicated with the main pump inlet and the inlet of the control valve.

8. The hydraulic system of claim 5, wherein:

fluid is communicated from the second port to the charge pump inlet via a restriction.

* * * * *